US007836809B2

(12) United States Patent
Noveske

(10) Patent No.: US 7,836,809 B2
(45) Date of Patent: Nov. 23, 2010

(54) FLASH SUPPRESSION SYSTEM

(76) Inventor: John Noveske, P.O. Box 1401, Grants Pass, OR (US) 97528

( * ) Notice: Subject to any disclaimer, the term of this patent is extended or adjusted under 35 U.S.C. 154(b) by 59 days.

(21) Appl. No.: 11/524,764

(22) Filed: Sep. 20, 2006

(65) Prior Publication Data

US 2010/0257996 A1 Oct. 14, 2010

(51) Int. Cl.
*F41A 21/34* (2006.01)

(52) U.S. Cl. ..... 89/14.4; 89/14.2

(58) Field of Classification Search ..... 89/14.2–14.5, 89/1.14

See application file for complete search history.

(56) References Cited

U.S. PATENT DOCUMENTS

| | | | | | |
|---|---|---|---|---|---|
| 1,259,251 | A | * | 3/1918 | Love | 89/14.3 |
| 2,150,161 | A | * | 3/1939 | Green | 89/14.3 |
| 2,447,205 | A | * | 8/1948 | Powell | 89/14.3 |
| 3,272,074 | A | * | 9/1966 | Vinson | 89/14.2 |
| 3,478,841 | A | * | 11/1969 | Hubner | 89/14.4 |
| 3,776,093 | A | * | 12/1973 | Leverance et al. | 89/14.4 |
| 4,024,790 | A | * | 5/1977 | Heiderer | 89/14.2 |
| 4,291,610 | A | * | 9/1981 | Waiser | 89/14.4 |
| 4,341,283 | A | * | 7/1982 | Mazzanti | 89/14.4 |
| 4,588,043 | A | | 5/1986 | Finn | |
| 4,813,333 | A | * | 3/1989 | Garris et al. | 89/14.3 |
| 4,869,151 | A | | 9/1989 | Chahin | 89/14.3 |
| 4,879,942 | A | * | 11/1989 | Cave | 89/14.3 |
| 4,928,573 | A | | 5/1990 | Fansler et al. | |
| 4,939,977 | A | * | 7/1990 | Stroup | 89/14.4 |
| 4,945,812 | A | | 8/1990 | Mazzanti | |
| 5,020,416 | A | | 6/1991 | Tripp | 89/14.3 |
| 5,036,747 | A | * | 8/1991 | McClain, III | 89/14.3 |
| 5,063,827 | A | * | 11/1991 | Williamson | 89/14.3 |
| 5,279,200 | A | | 1/1994 | Rose | 89/14.3 |
| 5,679,916 | A | * | 10/1997 | Weichert | 89/14.4 |
| 5,698,810 | A | | 12/1997 | Rose | 89/14.3 |
| 5,773,746 | A | | 6/1998 | Vaden | |
| 6,308,609 | B1 | | 10/2001 | Davies | |
| 6,374,718 | B1 | * | 4/2002 | Rescigno et al. | 89/14.4 |
| 6,575,074 | B1 | * | 6/2003 | Gaddini | 89/14.4 |
| 6,604,445 | B2 | | 8/2003 | Sevastian | |
| 6,923,292 | B2 | * | 8/2005 | Woods et al. | 89/14.4 |
| 7,059,235 | B2 | * | 6/2006 | Hanslick et al. | 89/14.3 |
| 2005/0188829 | A1 | * | 9/2005 | Hanslick et al. | 89/14.3 |

* cited by examiner

*Primary Examiner*—Michael Carone
*Assistant Examiner*—Jonathan C Weber
(74) *Attorney, Agent, or Firm*—Bennet K. Langlotz; Langlotz Patent & Trademark Works, Inc.

(57) ABSTRACT

A flash suppression system for increasing the reliability of an autoloading firearm has a body having a central bore including the front opening and a rear opening. The rear opening of the body terminates in a expansion feature having a front opening and a rear opening. The central bore of the body receives the rear opening of a conical element. The rear opening of the conical element is positioned within the central bore of the body to create a gap between the front opening of the expansion feature and the rear opening of the comical element. The front opening of the expansion feature has a larger diameter than the rear opening of the conical element.

5 Claims, 3 Drawing Sheets

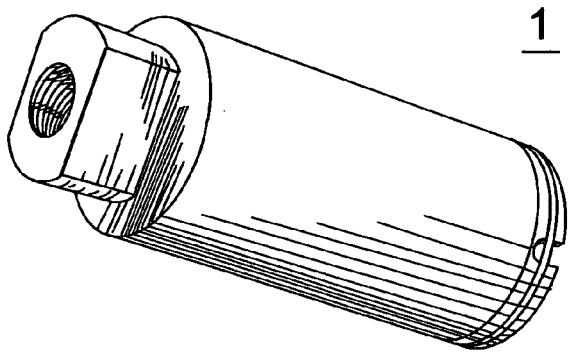
Fig. 1
Fig. 2
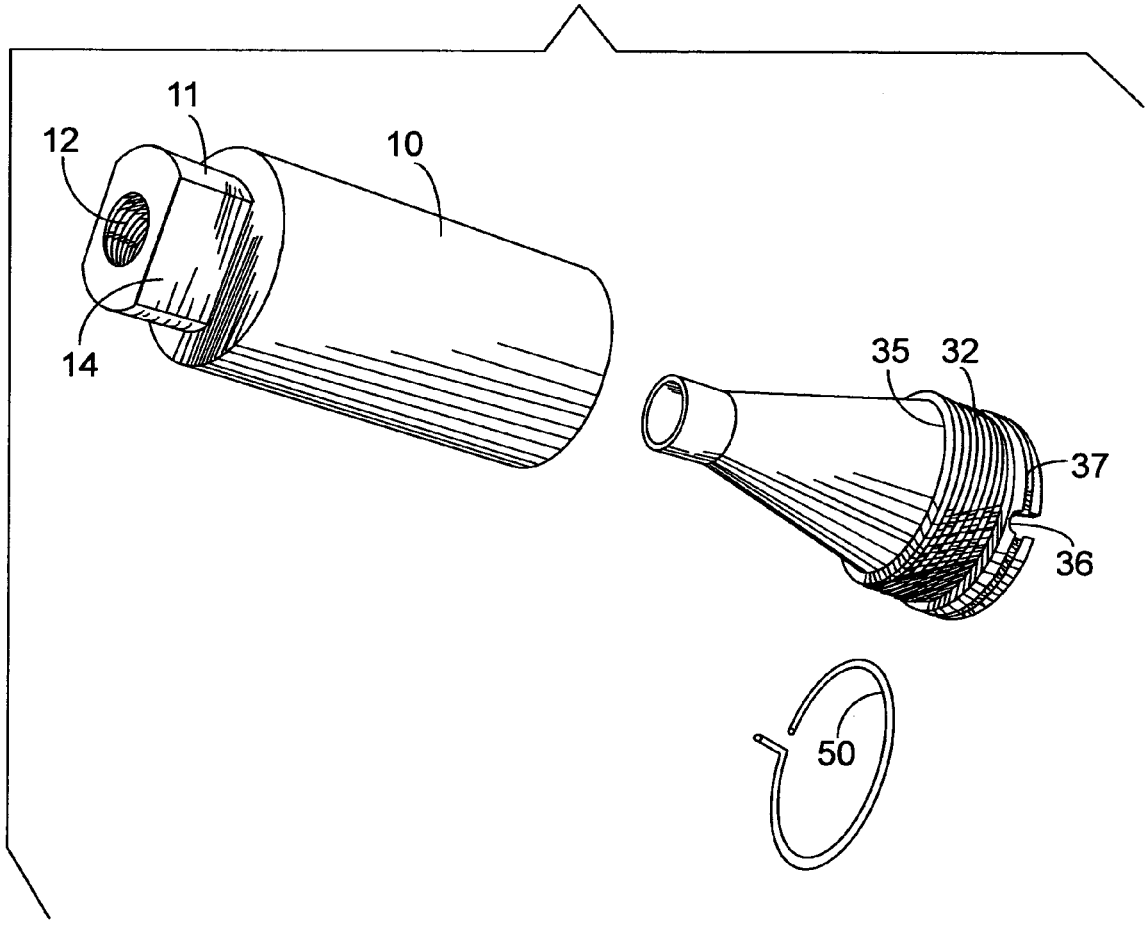

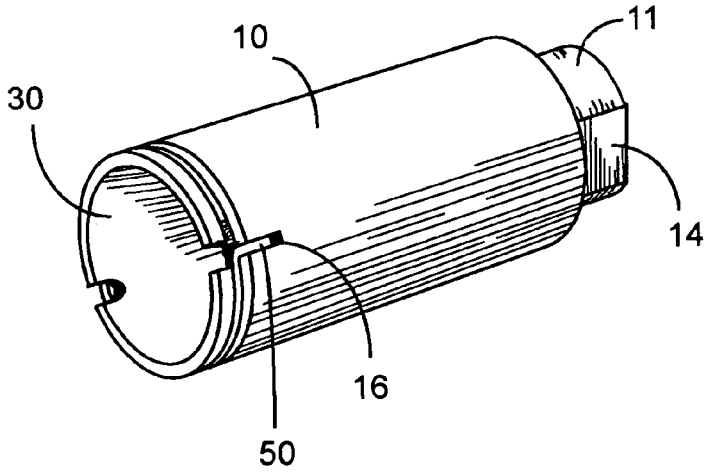
Fig. 3
Fig. 4
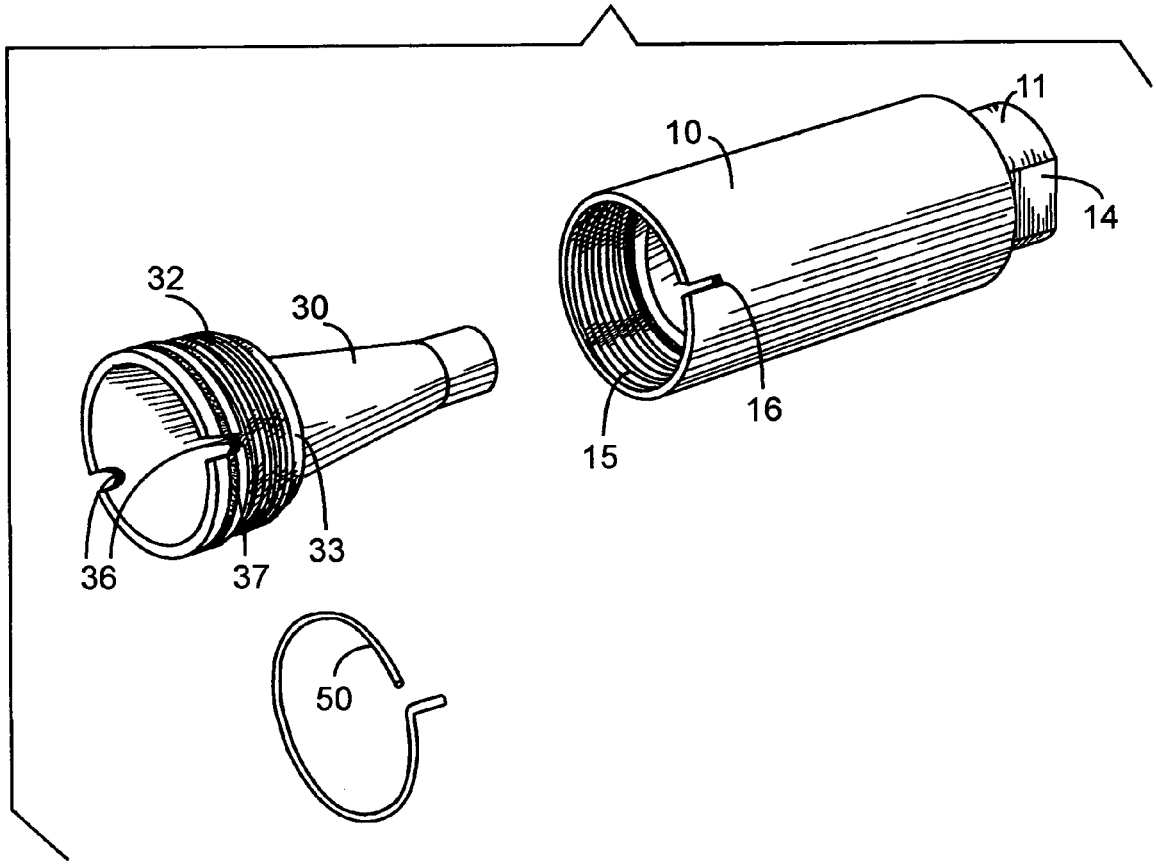

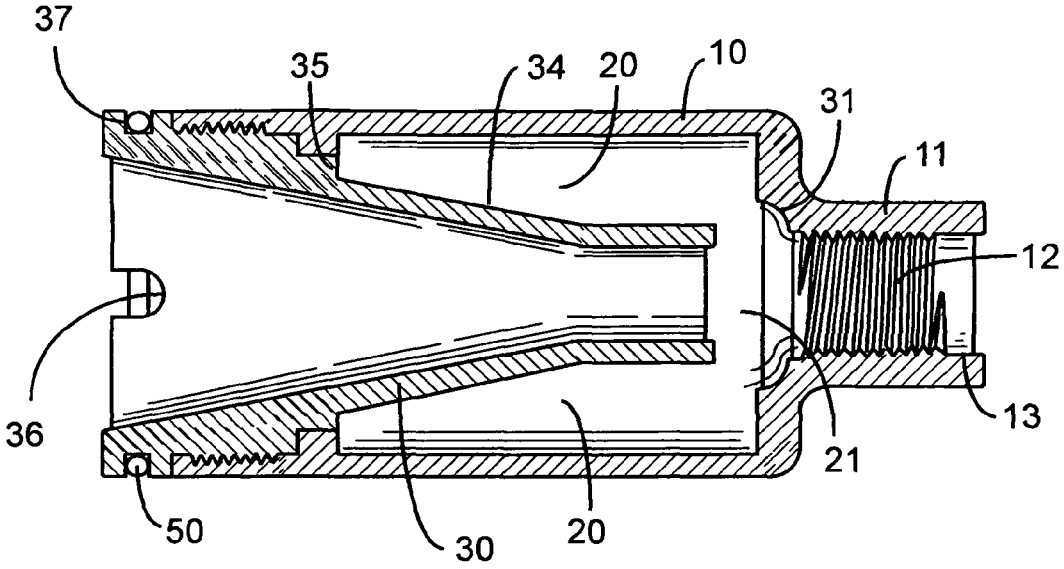
Fig. 5A
Fig. 5B
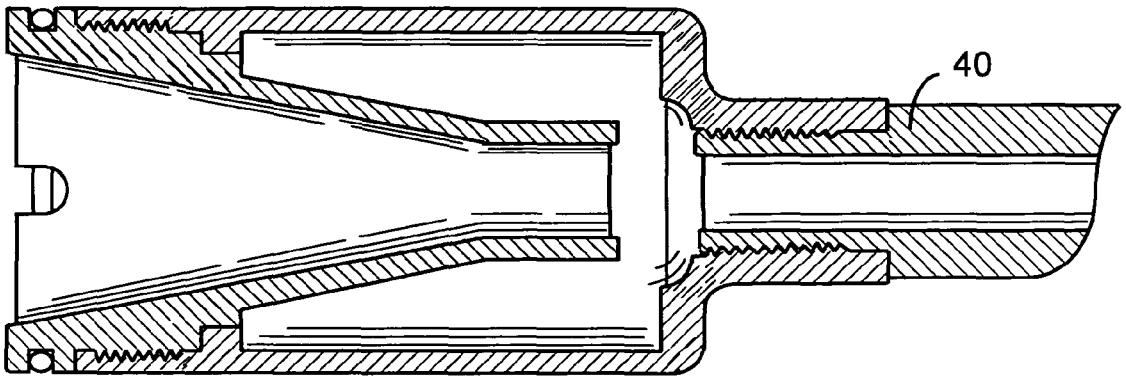

FLASH SUPPRESSION SYSTEM

FIELD OF THE INVENTION

The invention relates to a flash suppression system for use with a firearm that ignites a propellant to fire a projectile, and more particularly to a device that generates increased back-pressure for more reliable operation of gas-operated firearms.

BACKGROUND OF THE INVENTION

Flash suppressors are devices attached the muzzle of a rifle or other firearm that reduce the visible signature of the burning gases that exit the muzzle. This is useful from a tactical standpoint because it reduces the chance of the shooter's position will be given away and reduces the chance that the shooter will be blinded in dark conditions.

Early rifle designs tended to have longer barrels the modern assault rifles. The beneficial side effect of the long barrel is that the propellant is completely burnt before the bullet leaves the barrel, usually resulting in only a puff of smoke being emitted from the muzzle. With the advent of shorter rifle barrels, the bullet often leaves the barrel before the powder is completely consumed. The still burning powder emits a bright flash when it exits the muzzle. Since essentially all modern infantry weapons have short barrels with this problem that limits their use in night combat, flash suppressors are almost universally used on these weapons currently.

Flash suppressors reduce the muzzle flash from a firearm by diverting the incandescent gases resulting from firing the weapon to the sides, away from the shooter's line of sight. This also reduces the flash that is visible to the enemy. Slots, tubes, and/or holes in the outside body of the flash suppressor divert the gases and reduce or eliminate the flash by rapidly cooling the gases as they leave the end of the barrel. Although the overall amount of burning propellant is unchanged, the density and temperature greatly reduced, along with the brightness of the flash.

Previous flash suppressors have not been entirely satisfactory in hiding the flash because of unconsumed propellant exiting the suppressor and continuing to burn. Prior art flash suppressors are not easily removed, cleaned, and reassembled. Furthermore, previous flash suppressors do nothing to improve the function of the host weapon's autoloading capabilities. In addition, particularly in a military or law enforcement application, multiple shooters are closely arranged and firing side by side or above/below one another. Conventional flash suppressors emit a blast substantially perpendicularly to the barrel that could render the other shooters inoperative from the shocking concussion.

It is therefore an object of this invention to provide a flash suppression system that generates increased backpressure for more reliable operation of gas-operated firearms.

SUMMARY OF THE INVENTION

The present invention provides an improved flash suppression system, and overcomes the above-mentioned disadvantages and drawbacks of the prior art. As such, the general purpose of the present invention, which will be described subsequently in greater detail, is to provide an improved flash suppression system that has all the advantages of the prior art mentioned above.

To attain this, the preferred embodiment of the present invention essentially comprises a body having a central bore including the front opening and a rear opening. The rear opening of the body terminates in a expansion feature having a front opening and a rear opening. The central bore of the body receives the rear opening of a conical element. The rear opening of the conical element is positioned within the central bore of the body to create a gap between the front opening of the expansion feature and the rear opening of the comical element. The front opening of the expansion feature has a larger diameter than the rear opening of the conical element. Gas emitted from the muzzle end of the gunbarrel may accumulate within the central bore of the body and exert back pressure on the gun bore. The gap between the front opening of the expansion feature and the rear opening of the conical element may have a width that is at least one third of the diameter of the rear opening of the conical element. The rear opening of the conical element may closely receive a projectile fired from the gun bore.

It is an objective of the invention to provide a novel system that can be easily cleaned in the field and made ready to use again. The invention contains a mechanism to hold the two pieces together or more precisely a wire snap ring that fits into a circumferential groove of the forcing cone and is easily removed to allow quick removal of burnt powders, cleaned and quickly reassembly.

At the end of the suppressor body and at the end of the forcing cone are four grooves, two on the forcing cone, and two on the body of the suppressor. When screwed together, two grooves from the main body are separated 180 degrees apart, and two from the forcing cone 180 degrees apart and exactly line up to form two combined slots 180 degrees apart. The end of the snap ring is bent so it falls into one of these two slots preventing the forcing cone from unscrewing during use.

The forcing cone traps the expanding gases from the discharged firearm and delays their exit to the atmosphere thereby generating more back pressure. This increased back pressure aids in the reliable operation of short barreled autoloading firearms. The forcing cone also captures the gases expanding to the sides in a chamber between itself and the body of the suppressor. Gases are only permitted to exit from the front of the suppressor, away from adjacent shooters.

There are, of course, additional features of the invention that will be described hereinafter and which will form the subject matter of the claims attached.

There is thus been outlined, rather broadly, the more important features of the invention in order that the detailed description thereof that follows may be better understood and in order that the present contribution to the art may be better appreciated.

BRIEF DESCRIPTION OF THE DRAWINGS

FIG. 1 is a rear perspective view of the flash suppression system constructed in accordance with the principles of the present invention.

FIG. 2 is an exploded view of FIG. 1.

FIG. 3 is a top perspective view.

FIG. 4 is an exploded view of FIG. 3.

FIG. 5A is a side sectional view of the present invention.

FIG. 5B is side sectional view of the present invention mounted on a gun barrel.

DESCRIPTION OF THE CURRENT EMBODIMENT

A preferred embodiment of the mounting system of the present invention is shown and generally designated by the reference numeral 1.

FIGS. 1 & 2 illustrate the improved flash suppression system 1 of the present invention from the rear. More particularly, the suppression system has a body 10 in the form of a longitudinally extending tubular housing. The straight cylindrical body 10 includes a stepped down rear section 11. The rear section 11 also features a rear opening consisting of an internally threaded portion 12. These features on the rear of the body facilitate mounting the suppression system on the muzzle end of a firearm's gunbarrel 40 that includes external threads.

Specifically, the rear section 11 features milled installation flats 14. The flats on the rear section are received by a removal tool when installing or removing the suppression system. The internally threaded portion 12 mates with the external threads on the gunbarrel. The threaded portion 12 may come in a variety of thread dimensions for installation on a variety of firearms having different external thread dimensions.

The front of the body 10 contains internal threads 15 that mate with the external threads 32 on a forcing cone 30. Once the flash suppression system is assembled, a circular snap ring 50 is placed on the external end of the forcing cone. The snap ring terminates with a single 90-degree bend that fits into a groove 37 between the forcing cone and body of the suppressor, thereby locking the suppressor system together.

A flash suppression chamber 20 in the body enables the hot high-pressure gases behind the bullet to expand within the body and slowly be released in a forward direction through the forcing cone. The expansion and temporary containment of hot gases by the chamber produces backpressure, which aids in the reliable operation of gas-operated weapons by maintaining a high level of pressure between the gas port on the weapon and the suppression system.

The flash suppression chamber 20 is defined by the inside diameter of the body and the outside portion of the cone. The unique design of the cone 30 and body 10 establish a relationship with the host firearm's gunbarrel 40, which results in a gas expansion gap 21 between the muzzle of the gunbarrel 40 and the rearward portion of the cone. The gas expansion gap allows the high pressure gases behind the bullet to expand into the flash suppression chamber 20. This results in temporary containment of the initial concussion with a gradual release of pressure and concussion in a forward direction. This action reduces the concussion felt by the shooter. The impact of the gases on the forward section of the cone and inside of the body also helps counter the recoil felt by the shooter, thereby making the weapon more controllable while being fired.

The threaded section 12 also may include an internal thread relief 13, depending upon the application of the suppression system. Forward of this internally threaded section is a female expansion cone 31 machined into the body. The expansion cone assists in the expansion of gases into the flash suppression chamber 20.

The front of the device exposes the removable cone 30, which diverts gases inside the body 10 and forward away from the shooter. The interior of the cone or gas trap also acts as a flash suppressor. The cone features external mounting threads 32, which engage with internal threads 15 on the inside forward portion of the body 10. Behind the cone's external threads exists a straight cylindrical section 33, which mates with a straight cylindrical section in the body. The mating of these two straight cylindrical sections creates a gas seal, which helps prevent gases, carbon, and debris from escaping into the threads of the cone and body. Between the external conical portion of the cone 34 and the above mentioned straight cylindrical section 33 there is a gas deflecting step 35 positioned 90 degrees from the axis of the unit. The gas deflecting step also assists in deflecting gas, carbon, and debris from entering the threaded portion 32 of the cone 30 and the thread portion of the body 15.

The forward portion of the cone features two notches 36, which offer the shooter the ability to align a wire in the path of the bullet for wire cutting capability. The notches also offer the shooter the ability to remove the cone for disassembly with a variety of tools, including a cleaning rod.

The cone features a wire-retaining grove 37 cut around its diameter. The wire-retaining groove houses a wire retainer 50. The wire retainer 50 engages a corresponding wire retainer lock notch 16 in the body to prevent the cone from unscrewing unintentionally. Placing the wire retainer lock notch 16 directly behind one of the two disassembly notches 36 enables the shooter to easily push the 90-degree corner of the wire retainer 50 out of the lock notch 16 with an outward push through the corresponding disassembly notch 36.

While a current embodiment of mounting system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A flash suppression system for a firearm having a gunbarrel with a muzzle end and a gun bore consisting essentially of:

a body having a central bore including a front opening and a rear opening;

the rear opening of the body including mounting features that attach the body to the muzzle end of the gunbarrel;

the rear opening of the body terminating in an expansion feature having a front opening and a rear opening that enable fluid communication between the rear opening of the body and the central bore of the body;

the front opening of the body including mounting features operable to connect a conical element's exterior to the body;

the conical element having a central bore with a front opening and a rear opening;

the rear opening of the conical element being received by the central bore of the body;

the rear opening of the conical element being positioned within the central bore of the body to define a gap between the front opening of the expansion feature and the rear opening of the conical element;

the gap between the front opening of the expansion feature and the rear opening of the conical element enabling fluid communication between the front opening of the expansion feature and the central bore of the body; and the front opening of the expansion feature having a larger diameter than the rear opening of the conical element.

2. The flash suppression system of claim 1 wherein the central bore of the body and the exterior of the conical element define a chamber such that gas emitted from the muzzle end of the gunbarrel accumulates within the central bore of the body and exerts backpressure on the gun bore.

3. The flash suppression system of claim 1 wherein the gap between the front opening of the expansion feature and the rear opening of the conical element has a width that is at least one third of the diameter of the rear opening of the conical element.

4. The flash suppression system of claim 1 wherein the rear opening of the conical element closely receives a projectile fired from the gun bore.

5. The flash suppression system of claim 1 wherein the expansion feature is a female expansion cone.

* * * * *